US009212495B2

(12) United States Patent
Nakamura et al.

(10) Patent No.: US 9,212,495 B2
(45) Date of Patent: Dec. 15, 2015

(54) WORK MACHINE

(75) Inventors: Takanobu Nakamura, Hiroshima (JP); Yasushi Shigenari, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/239,889

(22) PCT Filed: Jul. 23, 2012

(86) PCT No.: PCT/JP2012/004653

§ 371 (c)(1), (2), (4) Date: Feb. 20, 2014

(87) PCT Pub. No.: WO2013/027328

PCT Pub. Date: Feb. 28, 2013

(65) Prior Publication Data

US 2014/0205413 A1 Jul. 24, 2014

(30) Foreign Application Priority Data

Aug. 24, 2011 (JP) ..... 2011-182644

(51) Int. Cl.

| | |
|---|---|
| ***E04G 23/08*** | (2006.01) |
| ***E02F 3/30*** | (2006.01) |
| ***E02F 3/36*** | (2006.01) |

(Continued)

(52) U.S. Cl.

CPC ..... *E04G 23/08* (2013.01); *E02F 3/302* (2013.01); *E02F 3/369* (2013.01); *E02F 3/38* (2013.01); *E02F 3/425* (2013.01); *E02F 3/965* (2013.01); *E02F 9/2275* (2013.01); *E04G 23/082* (2013.01)

(58) Field of Classification Search

CPC ..... E02F 3/302; E02F 3/965; E02F 9/14

See application file for complete search history.

(56) References Cited

U.S. PATENT DOCUMENTS

2011/0188982 A1* 8/2011 Irieda et al. ..... 414/722

FOREIGN PATENT DOCUMENTS

| | | |
|---|---|---|
| EP | 2 354 327 A1 | 8/2011 |
| JP | 5 35969 | 5/1993 |

(Continued)

OTHER PUBLICATIONS

International Search Report Issued Aug. 28, 2012 in PCT/JP12/004653 Filed Jul. 23, 2012.

(Continued)

*Primary Examiner* — Ernesto Suarez
*Assistant Examiner* — Ronald Jarrett
(74) *Attorney, Agent, or Firm* — Oblon, McClelland, Maier & Neustadt, L.L.P.

(57) ABSTRACT

A work machine capable of decreasing the height of a work attachment in a folded state and suppressing the influence on the operability during demolishing operation. An arm has a surface facing downward when the attachment is in a folded posture, and the surface includes a flat arm contact surface capable of making contact with a mounting surface, on which a work attachment is mounted; and an attachment surface that extends in the direction away from the mounting surface. A work device cylinder is attached to the attachment surface so as not to make contact with the mounting surface. When the attachment is in the attachment folded posture, the arm contact surface is more parallel to a boom upper surface than a boom-side sloped surface and an arm-side sloped surface or is parallel to the boom upper surface.

5 Claims, 9 Drawing Sheets

(51) Int. Cl.

| | |
|---|---|
| ***E02F 3/96*** | (2006.01) |
| ***E02F 9/22*** | (2006.01) |
| ***E02F 3/38*** | (2006.01) |
| ***E02F 3/42*** | (2006.01) |

(56) References Cited

FOREIGN PATENT DOCUMENTS

| | | |
|---|---|---|
| JP | 5 67652 | 9/1993 |
| JP | 07 317329 | 12/1995 |
| JP | 11 193542 | 7/1999 |
| JP | 11 193543 | 7/1999 |
| JP | 2007 203221 | 8/2007 |
| JP | 2007 205067 | 8/2007 |
| JP | 2010-203149 | 9/2010 |

OTHER PUBLICATIONS

Extended European Search Report issued Apr. 14, 2015 in European Patent Application No. 12826480.1.

* cited by examiner

WORK MACHINE

TECHNICAL FIELD

The present invention relates to a work machine such as a demolishing machine that includes a base machine and a work attachment attached to the base machine.

BACKGROUND ART

Conventionally, various work machines such as a demolishing machine in which a work attachment is attached to a base machine have been proposed. For example, a demolishing machine with a super long attachment used in demolishing a high-rise building as disclosed in Patent Document 1 is configured to be able to receive or transport a long work attachment 4 in a folded state.

As illustrated in FIG. 8, this demolishing machine includes a base machine 3 and a work attachment 4 attached to a front part thereof. The base machine 3 includes a crawler-type lower traveling body 1 and an upper turning body 2. The upper turning body 2 is mounted on the lower traveling body 1 so as to be revolvable about a vertical axis.

The work attachment 4 includes a boom 5, a short inter-boom 6, an arm 7, and a work device 8. The boom 5 is attached to the base machine 3, specifically to the upper turning body 2 of the base machine 3, so as to be freely raised and lowered. The inter-boom 6 is attached to a distal end of the boom 5 so as to be rotatable about a horizontal axis in order to expand the working range of the work attachment 4. The arm 7 is attached to a distal end of the inter-boom 6 so as to be rotatable about the horizontal axis. The work device 8 is attached to a distal end of the arm 7. The work device 8 illustrated in FIG. 8 is a crushing device called a nibbler.

The boom 5 includes a main boom 5*a* and a front boom 5*b* that is detachably connected to an upper end side thereof. When the demolishing machine is transported, the demolishing machine is disassembled into the base machine 3 and the work attachment 4. In this case, the main boom 5*a* is transported in a state of being attached to the base machine 3.

Although the front boom 5*b* is generally formed by detachably connecting a plurality of stages of booms, a single-stage front boom is illustrated for the sake of simplicity.

Moreover, a boom cylinder 9 that raises and lowers the boom 5 and the entire attachment including the boom 5, an inter-boom cylinder 10 that operates the inter-boom 6, an arm cylinder 11 that operates the arm 7, and a work device cylinder 12 that operates the work device 8 are provided as a cylinder such as a hydraulic cylinder that operates the work attachment 4.

The inter-boom cylinder 10 is provided between the boom 5 (specifically, the front boom 5*b* of the boom 5) and the inter-boom 6, and the arm cylinder 11 is provided between the inter-boom 6 and the arm 7, respectively, on the belly side (that is, the side facing the front side (the direction indicated by arrow F) of the base machine 3) of the attachment.

The work device cylinder 12 is attached to a distal end side of the arm 7 on the back side (that is, the side facing the backward side (the direction indicated by arrow R) of the base machine 3) of the work attachment 4 in a state where the work attachment 4 is extended to stand up.

When such a demolishing machine with a super long attachment is disassembled, as illustrated in FIG. 8 (see the solid-line portion) and FIG. 9, the work attachment 4 is placed on a ground in a three-fold state so that the boom 5 is disposed above the inter-boom 6 and the arm 7 is disposed below the inter-boom 6. In this state, as described above, the demolishing machine is transported in a state of being separated into a group composed of the base machine 3 and the main boom 5*a* and a group composed of the work attachment 4 excluding the main boom 5*a*. The group of the work attachment 4 is transported in a posture where the entire group is folded.

However, in a state where the work attachment 4 is in the folded posture, since the work device cylinder 12 is positioned below the arm 7, when the attachment 4 is placed directly on a ground or the like in a folded state, the work device cylinder 12 may be damaged. Thus, conventionally, a bracket 13 that protrudes toward the lower side of the arm 7 is provided. By allowing the bracket 13 to make contact with a ground, the work attachment 4 can be placed on a ground or the like in a state where the arm 7 is above a ground or the like. However, in the configuration where the bracket 13 is provided, there is a problem in that the height H1 of the attachment 4 increases when the attachment 4 is placed on a ground or the like in a folded state.

Moreover, in order to decrease the height H1, a structure may be taken into consideration in which in a state where the attachment 4 is in a folded posture, the work device cylinder 12 is attached to a surface facing upward of the arm 7, a surface facing downward of the arm 7 is flat, and the flat surface is placed directly on a ground. However, in this case, since the position of the work device cylinder 12 in relation to the arm 7 is greatly different from that of a conventional work machine, a method of operating the demolishing machine is changed greatly, which may influence the operability during demolishing.

There is another problem in that, when the work device cylinder 12 is attached to a surface facing upward of the arm 7, in a state where the attachment 4 is in a folded posture, the disposition of the arm 7 and the boom 5*b* in a close proximity with each other becomes difficult to implement.

Moreover, in order to secure the space for receiving the work device cylinder 12 between the arm 7 and the boom 5*b* in the folded posture of the attachment 4, it is necessary to attach the boom 5*b* in a state of being inclined upward with respect to the extension direction of the arm 7. The height of the attachment in the folded state increases. Further, since the entire height of the boom 5*b* is not constant, it is not desirable from the perspective of transporting property and maintenance operability.

Patent Document 1: Japanese Patent Application Publication No. 2007-203221

SUMMARY OF THE INVENTION

An object of the present invention is to provide a work machine capable of decreasing the height of the work attachment in a folded state and suppressing the influence on the operability during demolishing.

A work machine of the present invention is a work machine in which a work attachment is attached to a base machine, the work attachment including: a boom attached to the base machine so as to be raised and lowered; an inter-boom attached to a distal end of the boom so as to be rotatable about a horizontal axis; an arm attached to a distal end of the inter-boom so as to be rotatable about the horizontal axis; a work device attached to a distal end of the arm; an inter-boom cylinder provided on a belly side of the work attachment and between the boom and the inter-boom so as to rotate the inter-boom; an arm cylinder provided on the belly side of the work attachment and between the inter-boom and the arm so as to move the arm; and a work device cylinder provided in a portion of a back side of the work attachment close to the distal end of the arm, wherein the work attachment can be folded in a three-fold manner into such an attachment folded posture that the boom is disposed on the upper side of the inter-boom and the arm is disposed on the lower side of the inter-boom, the boom has a boom-side sloped surface that is disposed on a distal end side of the boom and on a lower side of the boom in the attachment folded posture so as to be sloped downward as the boom-side sloped surface advances toward a base side of the boom, and the inter-boom cylinder is attached between the boom-side sloped surface and the inter-boom, the arm has an arm-side sloped surface that is disposed on a base side of the arm and on an upper side of the arm in the attachment folded posture so as to be sloped upward as the arm-side sloped surface advances toward the distal end of the arm, and the arm cylinder is attached between the arm-side sloped surface and the inter-boom, the arm has a surface facing downward when the attachment is in the attachment folded posture, the surface including a flat arm contact surface capable of making contact with a mounting surface, on which the work attachment is mounted, and an attachment surface that is positioned closer to the distal end of the arm than the arm contact surface and extends in a direction away from the mounting surface, and the work device cylinder is attached to the attachment surface so as not to make contact with the mounting surface when the arm contact surface makes contact with the mounting surface, and the boom has a boom upper surface that faces upward when the attachment is in the attachment folded posture, and the boom upper surface is formed to be more parallel to the arm contact surface than the boom-side sloped surface and the arm-side sloped surface or to be parallel to the arm contact surface when the attachment is in the attachment folded posture.

According to this configuration, the work attachment can be folded in a three-fold manner into such an attachment folded posture that the boom is disposed above the inter-boom and the arm is disposed below the inter-boom. The arm has the surface facing downward when the attachment is in the attachment folded posture, and the surface includes the flat arm contact surface capable of making contact with the mounting surface on which the work attachment is mounted, and the attachment surface that is positioned closer to the distal end of the arm than the arm contact surface and extends in the direction away from the mounting surface. The work device cylinder is attached to the attachment surface so as not to make contact with the mounting surface when the arm contact surface makes contact with the mounting surface such as a ground or a floor. Due to this, when the attachment is in the attachment folded posture, the space occupied by the work device cylinder decreases and the height of the attachment in the folded posture can be decreased. Moreover, the attachment can be mounted on a predetermined ground, a predetermined floor, or the like in a stable state. Further, since the position at which the work device cylinder is attached to the arm is the same as the conventional demolishing machine, it is not necessary to change a method of operating the demolishing machine and to suppress the influence on the operability during demolishing.

Further, the inter-boom cylinder is attached between the inter-boom and the boom-side sloped surface formed close to the distal end of the boom, and the arm cylinder is attached between the inter-boom and the arm-side sloped surface formed on the base side of the arm. Due to this, when the attachment is in the attachment folded posture, the inter-boom cylinder and the arm cylinder are received between the boom-side sloped surface and the arm-side sloped surface. Moreover, the boom upper surface of the boom facing upward when the attachment is in the attachment folded posture is more parallel to the arm contact surface than the boom-side sloped surface and the arm-side sloped surface or is parallel to the arm contact surface when the attachment is in the attachment folded posture. Due to this, it is possible to decrease the height of the attachment in the folded posture as compared to when the boom upper surface is sloped with respect to the arm contact surface.

It is preferable that, the inter-boom cylinder and the arm cylinder are disposed so as to cross each other in a side view of the work attachment when the work attachment is in the attachment folded posture.

According to this configuration, the inter-boom cylinder and the arm cylinder are disposed so as to cross each other in a side view of the work attachment when the work attachment is in the attachment folded posture. Due to this, the space occupied by the inter-boom cylinder and the arm cylinder decreases when the attachment is in the attachment folded posture, and the height of the attachment in the folded posture can be decreased.

It is preferable that the boom has a boom-side facing surface that is disposed on the base side of the boom so as to face downward when the attachment is in the attachment folded posture, the arm has an arm-side facing surface that is disposed on the distal end side of the arm so as to face upward when the attachment is in the attachment folded posture, the boom-side facing surface and the arm-side facing surface face each other when the attachment is in the attachment folded posture, and the boom-side facing surface is formed to be more parallel to the arm-side facing surface than the boom-side sloped surface and the arm-side sloped surface or to be parallel to the arm-side facing surface when the attachment is in the attachment folded posture.

According to this configuration, the boom-side facing surface formed on the base side of the boom is more parallel to the arm-side facing surface formed close to the distal end of the arm than the boom-side sloped surface and the arm-side sloped surface or is parallel to the arm-side facing surface when the attachment is in the attachment folded posture. Due to this, it is possible to decrease the distance between the boom-side facing surface and the arm-side facing surface facing each other and to further decrease the height of the attachment in the folded posture.

It is preferable that the work attachment has a center of gravity that is positioned on the arm contact surface in the attachment folded posture.

According to this configuration, the center of gravity of the work attachment is positioned on the arm contact surface in the folded posture. Due to this, the work attachment in the folded posture can be mounted on a predetermined ground or a predetermined floor in a more stable state.

BEST MODE FOR CARRYING OUT THE INVENTION

Figure 1:
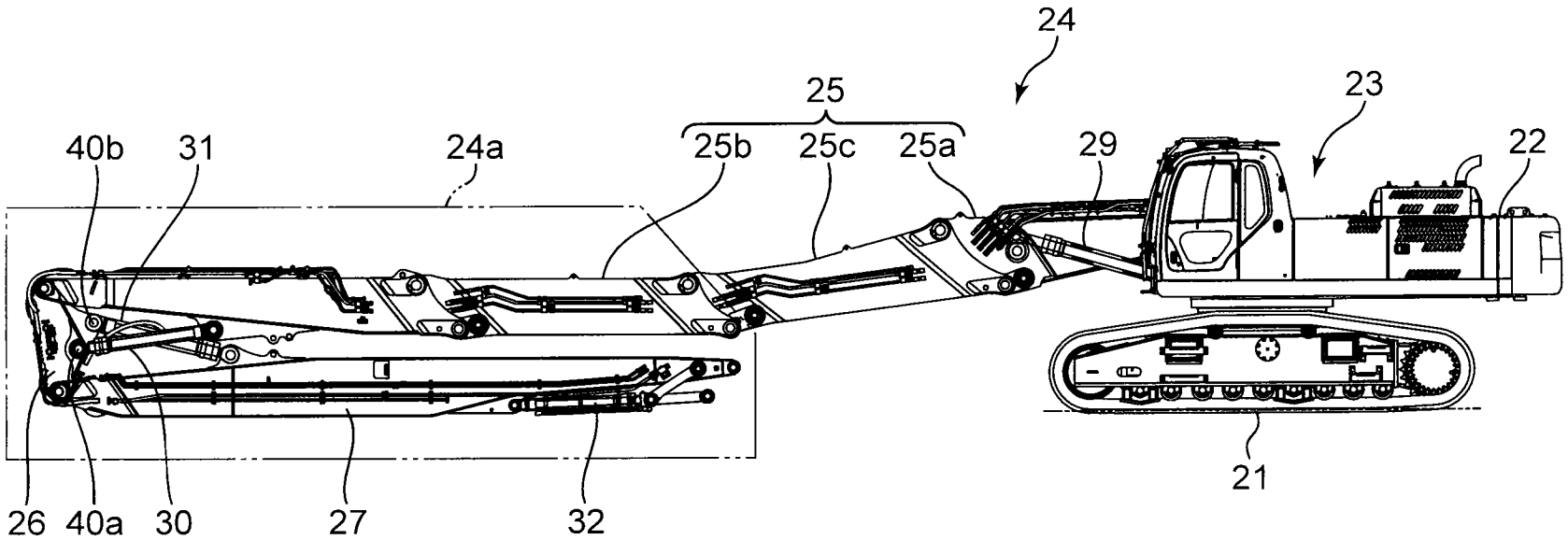
FIG. 1 is a schematic side view illustrating a folded state of a demolishing machine with a super long attachment according to an embodiment of a work machine of the present invention.

In the following embodiment, a demolishing machine with a super long attachment is described as one embodiment of a work machine according to the present invention in conformity with the description of the background art.

As illustrated in FIGS. 1 to 4, a demolishing machine of the present embodiment includes a base machine 23 and a work attachment 24. The base machine 23 includes a crawler-type lower traveling body 21 and an upper turning body 22. The upper turning body 22 is mounted on the lower traveling body 21 so as to be revolvable about a vertical axis. The work attachment 24 is attached to a front part of the base machine 23.

The work attachment 24 includes a boom 25, a short inter-boom 26, an arm 27, and a work device (not illustrated). The boom 25 is attached to the base machine 23, specifically to the upper turning body 22, so as to be freely raised and lowered. The boom 25 includes a main boom 25*a*, a front boom 25*b*, and an insert boom 25*c*. The inter-boom 26 is attached to a distal end portion 25*b*0 of the front boom 25*b* so as to be rotatable in an up-down direction. The arm 27 is attached to a distal end of the inter-boom 26 so that a rear end portion 27*h* is rotatable in the up-down direction. The work device (not illustrated) is attached to a distal end portion of the arm 27. A nibbler (see reference numeral 8 of FIG. 8) or the like is used as the work device, for example.

Moreover, a boom cylinder 29 that raises and lowers the boom 25 and the entire attachment including the boom 25, an inter-boom cylinder 30 that operates the inter-boom 26, an arm cylinder 31 that operates the arm 27, and a work device cylinder 32 that operates the work device (not illustrated) are provided in the work attachment 24 as a cylinder that operates the work attachment 24.

Figure 8:
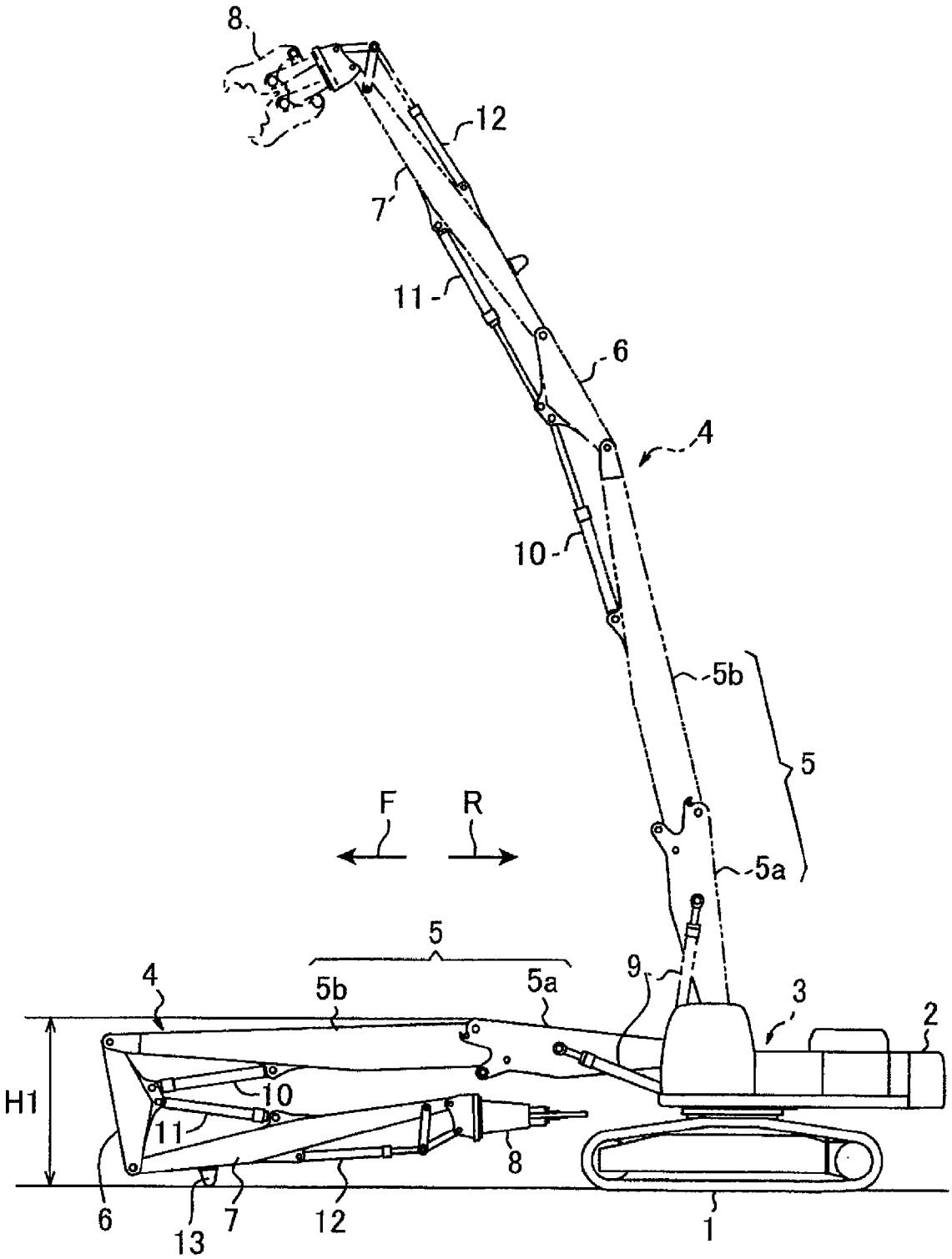
PRIOR ART FIG. 8
FIG. 8 is a schematic side view illustrating a conventional demolishing machine.

Further, on the belly side (that is, the side facing the front side (the direction indicated by arrow F) of the base machine 3 in a state where the attachment is extended to stand up as illustrated in FIG. 8) of the attachment, the inter-boom cylinder 30 and the arm cylinder 31 are provided between the boom 25 (specifically, the front boom 25*b*) and the inter-boom 26 and between the inter-boom 26 and the arm 27, respectively, and are connected by attachment pins 40*a* to 40*d* described later so as to be rotatable. Moreover, the work device cylinder 32 is attached to a distal end side of the arm 27 on the back side (that is, the side facing the backward side (the direction indicated by arrow R) of the base machine 3 in a state where the attachment is extended to stand up as illustrated in FIG. 8) of the work attachment 24.

Figure 2:
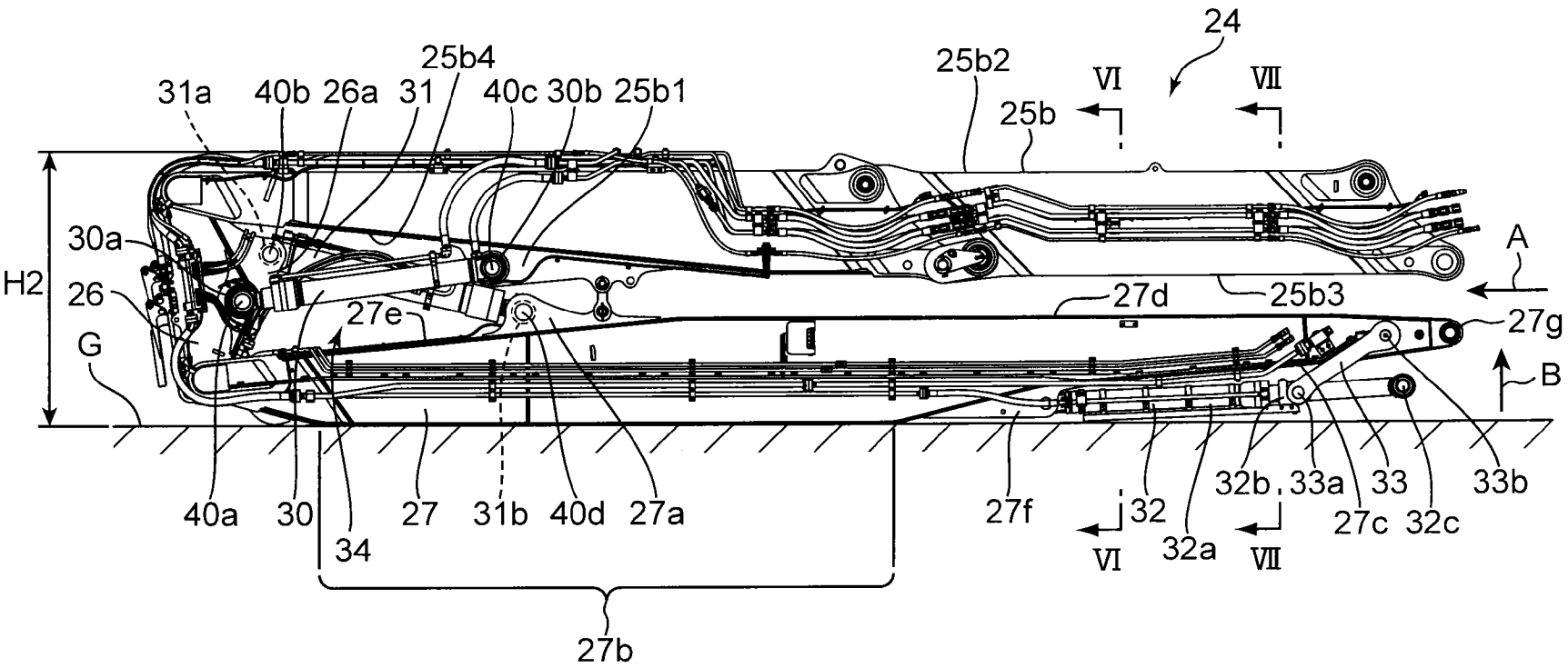
FIG. 2 is a side view illustrating the folded state of a work attachment of FIG. 1.

Moreover, as illustrated in FIGS. 1 and 2, when the work attachment 24 is folded and transported, the work attachment 24 is placed on a ground in a three-fold state so that the boom 25*b* is disposed above the inter-boom 26 and the arm 27 is disposed below the inter-boom 26. In this state, the demolishing machine is transported in a state of being separated into a group composed of the base machine 23 and the main boom 25*a*, a group composed of the work attachment 24*a* excluding the main boom 25*a* and the insert boom 25*c*, and the insert boom 25*c*. After transporting, the separated groups are assembled into the same state.

Figure 9:
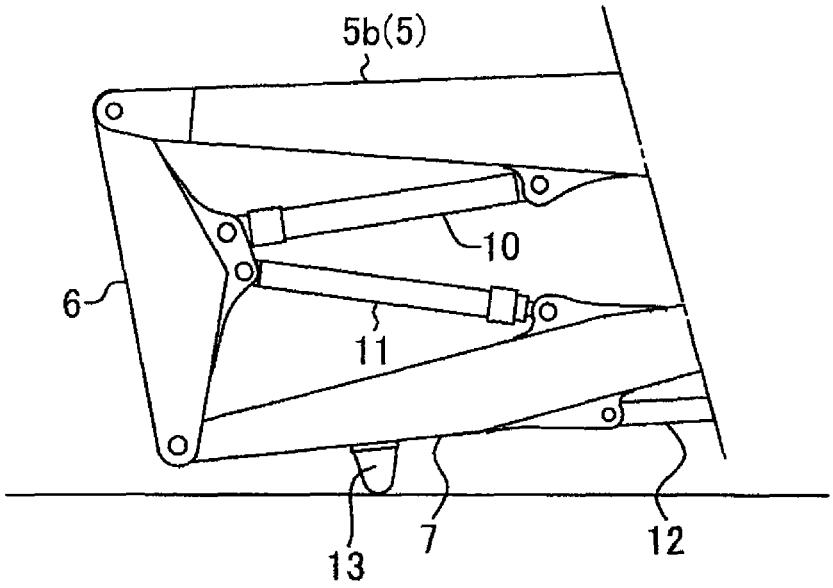
PRIOR ART FIG. 9
FIG. 9 is an enlarged view of part of FIG. 8.

The above configuration is substantially the same as the conventional demolishing machine illustrated in FIGS. 8 and 9.

However, as illustrated in FIGS. 1 and 2, the demolishing machine of the present embodiment is different from the conventional demolishing machine in the following respects:

(a) In an attachment folded posture, the inter-boom cylinder 30 and the arm cylinder 31 are disposed so as to cross each other;

(b) In the attachment folded posture, the work device cylinder 32 is attached to an arm attachment surface 27*c* that is disposed in a surface facing downward of the arm 27 in the attachment folded posture and extends upward more than an arm contact surface 27*b*; and (c) A boom upper surface 25*b*2 facing upward when the attachment is in the attachment folded posture is more parallel to the arm contact surface 27*b* than a boom-side sloped surface 25*b*4 and an arm-side sloped surface 27*e* or is parallel to the arm contact surface 27*b*. Hereinafter, these differences will be described in more detail.

Figure 3:
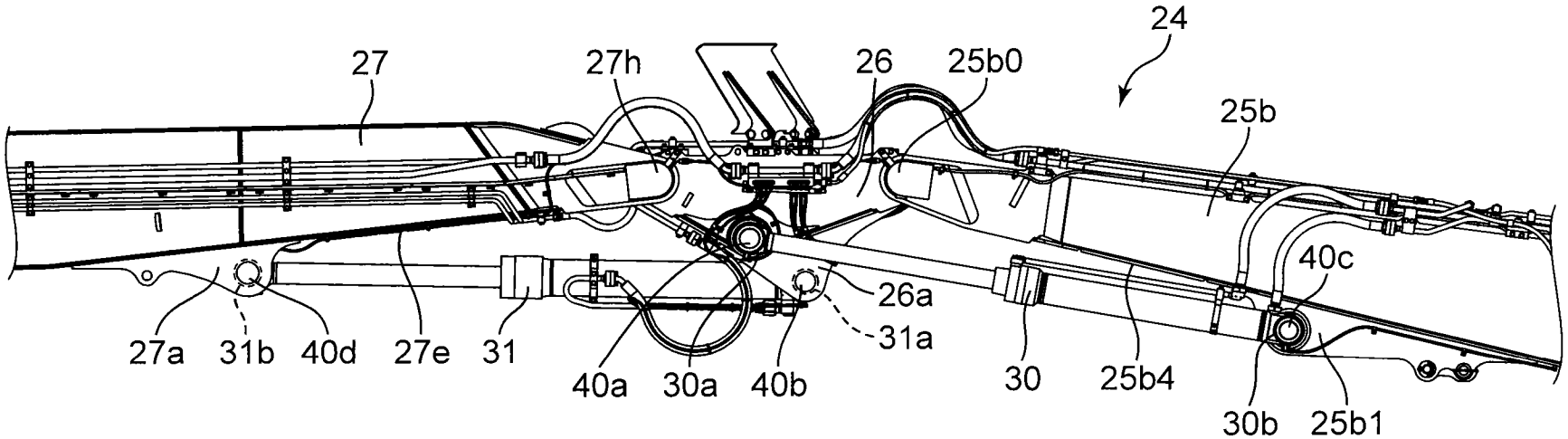
FIG. 3 is an enlarged side view illustrating the portions around an inter-boom in an extended state of the work attachment of FIG. 1.
Figure 4:
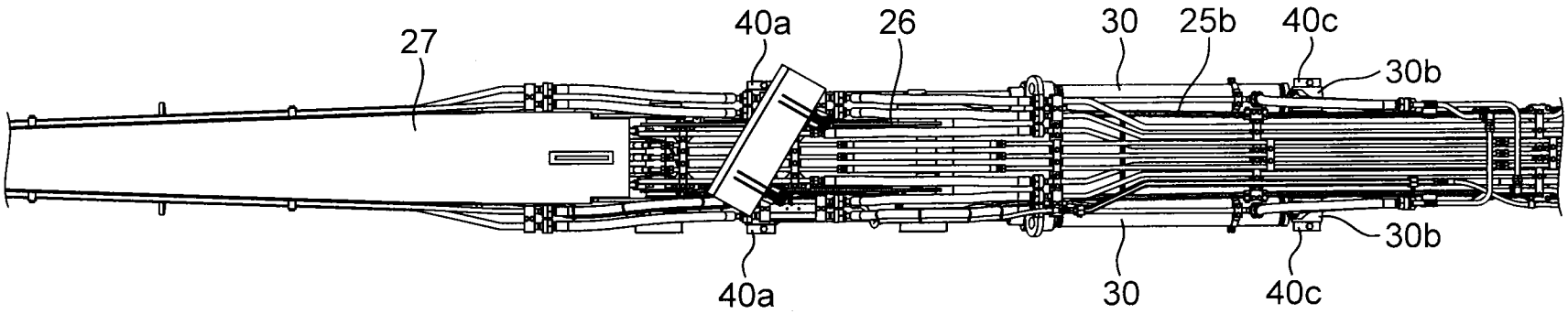
FIG. 4 is an enlarged plan view illustrating the portions around the inter-boom in an extended state of the work attachment of FIG. 1.
Figure 5:
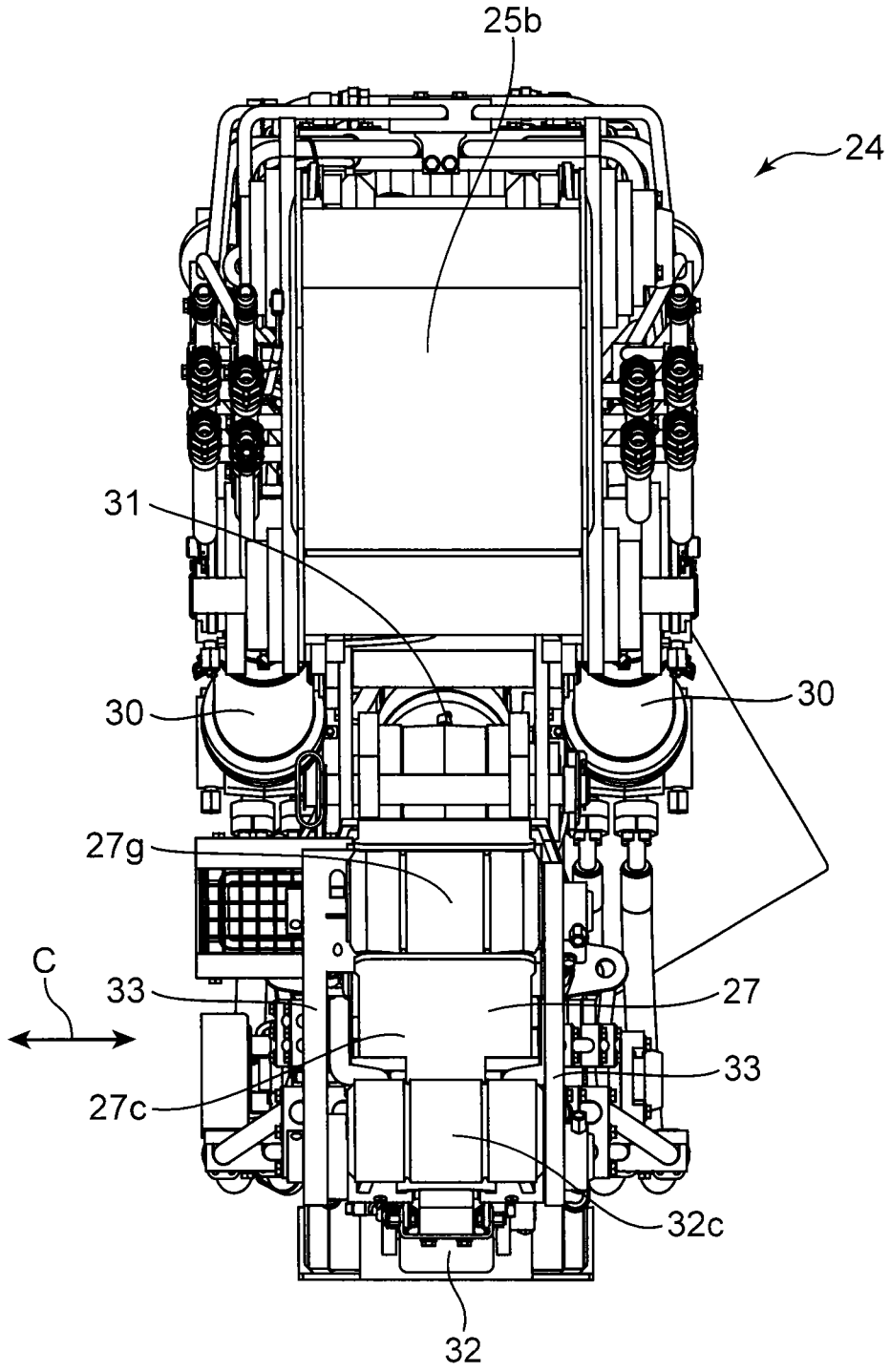
FIG. 5 is a view of the work attachment of FIG. 2 when seen from the direction indicated by arrow A.
Figure 6:
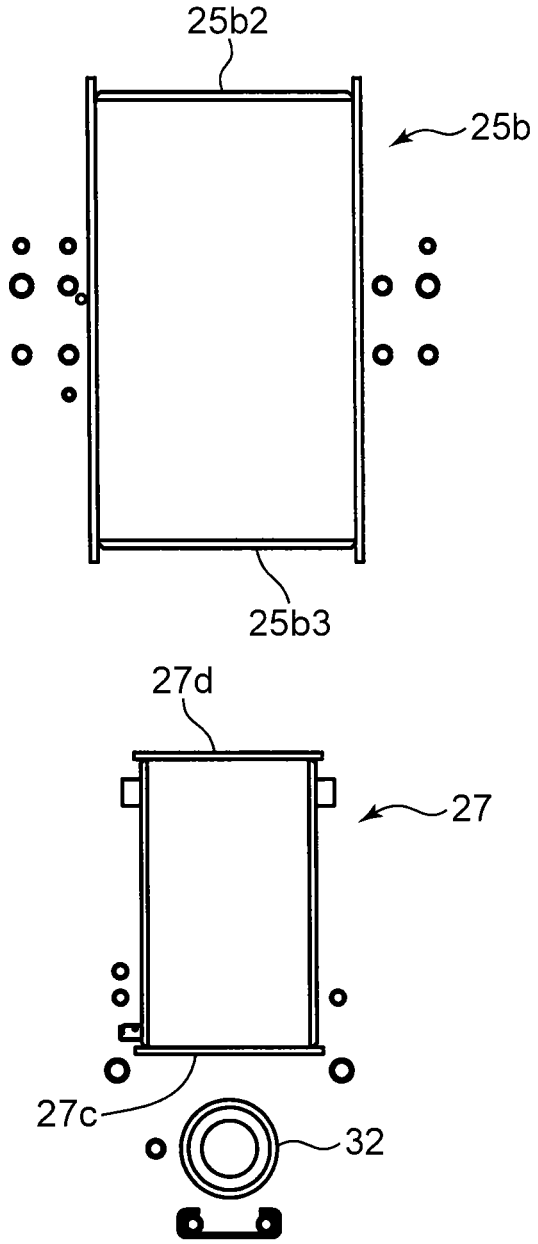
FIG. 6 is a cross-sectional view of the work attachment of FIG. 2 taken along line VI-VI.
Figure 7:
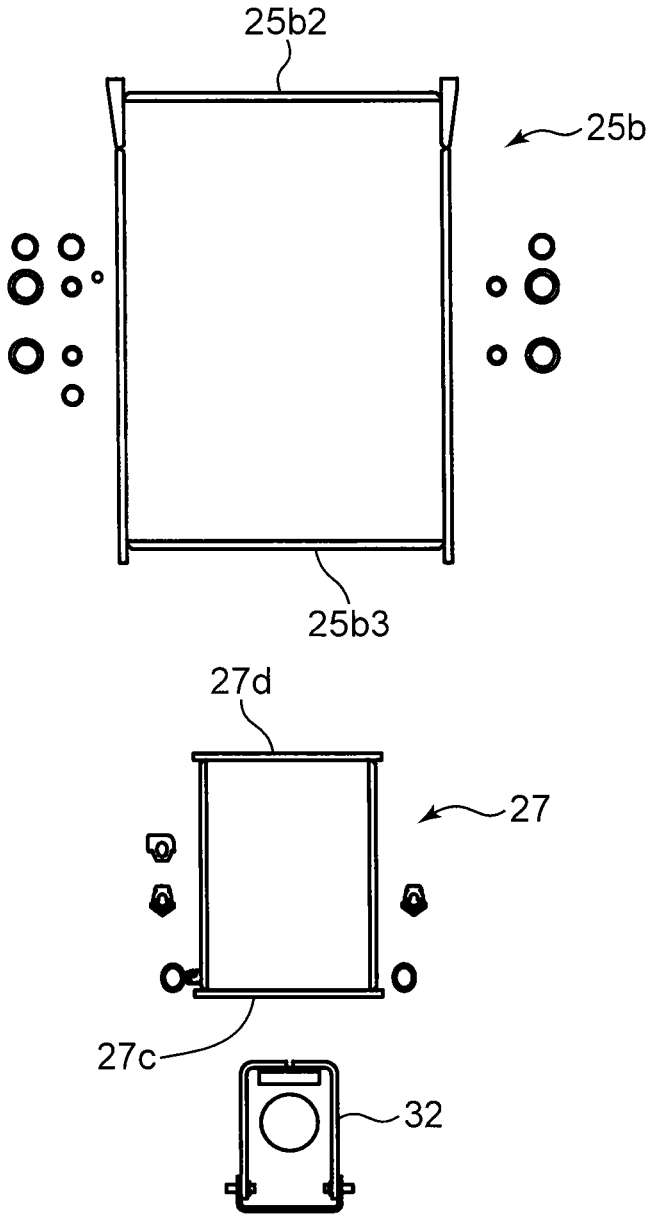
FIG. 7 is a cross-sectional view of the work attachment of FIG. 2 taken along line VII-VII.

As illustrated in FIGS. 3 and 4, two inter-boom cylinders 30 are connected to the inter-boom 26 by a first attachment pin 40*a* described later so as to be separated from each other in a width direction of the inter-boom 26. Moreover, as illustrated in FIG. 5, one arm cylinder 31 is connected to a protruding portion 26*a* (see FIG. 3) of the inter-boom 26 by a second attachment pin 40*b* described later at a position sandwiched by the two inter-boom cylinders 30.

As illustrated in FIGS. 1 to 4, the first attachment pin 40*a* connects one end portion 30*a* of the inter-boom cylinder 30 to the inter-boom 26 so as to be rotatable about the horizontal axis. The first attachment pin 40*a* is attached so as to move in a horizontal direction and to be inserted to and removed from a position close to the front side (the left side of FIG. 3) of the inter-boom 26.

The second attachment pin 40*b* connects one end portion 31*a* of the arm cylinder 31 to a protruding portion 26*a* protruding downward from a position close to the rear side (the right side of FIG. 3) of the inter-boom 26 so as to be rotatable about the horizontal axis. The second attachment pin 40*b* is attached so as to move in the horizontal direction and to be inserted to and removed from a position close to the rear side of the inter-boom 26 and lower than the first attachment pin 40*a*.

A third attachment pin 40*c* connects the other end portion 30*b* of the inter-boom cylinder 30 to an attachment portion 25*b*1 protruding from a circumferential surface of the front boom 25*b* so as to be rotatable about the horizontal axis. The third attachment pin 40*c* is attached so as to move in the horizontal direction and to be inserted to and removed from the front boom 25*b*. As illustrated in FIG. 2, the front boom 25*b* has in the front boom 25*b* a boom-side sloped surface 25*b*4 that is provided on a distal end side of the front boom 25*b* so as to be sloped downward as it advances toward a base side (the right side of FIG. 2) of the front boom 25*b* in the attachment folded posture. The attachment portion 25*b*1 is provided so as to protrude downward from the boom-side sloped surface 25*b*4. With this configuration, the inter-boom cylinder 30 is attached between the front boom-side sloped surface 25*b*4 and the inter-boom 26.

A fourth attachment pin 40*d* connects the other end portion 31*b* of the arm cylinder 31 to an attachment portion 27*a* protruding from the circumferential surface of the arm 27 so as to be rotatable about the horizontal axis. The fourth attachment pin 40*d* is attached so as to move in the horizontal direction and to be inserted to and removed from the arm 27. As illustrated in FIG. 2, the arm 27 has an arm-side sloped surface 27*e* that is provided on the base side of the arm 27 so as to be sloped upward as it advances toward and a distal end 27*g* (the right side of FIG. 2) of the arm 27 on the upper side of the arm 27 in the attachment folded posture. The attachment portion 27*a* is provided so as to protrude upward from the arm-side sloped surface 27*e*. With this configuration, the arm cylinder 31 is attached between the arm-side sloped surface 27*e* and the inter-boom 26.

As illustrated in FIGS. 1 and 2, when the work attachment 24 is folded in a three-fold manner into such an attachment folded posture that the front boom 25*b* is disposed above the inter-boom 2 and the arm 27 is disposed below the inter-boom 2, the second attachment pin 40*b* is disposed above the first attachment pin 40*a* when seen from the side surface of the work attachment. Further, the inter-boom cylinder 30 and the arm cylinder 31 are disposed so as to cross each other.

Moreover, as illustrated in FIG. 2, the arm 27 has a surface facing downward when the attachment is in the attachment folded posture. The surface includes the flat arm contact surface 27*b* capable of making contact with a mounting surface G (for example, a ground or a floor) on which the attachment is mounted, and the attachment surface 27*c* that is positioned closer to the distal end 27*g* of the arm 27 than the arm contact surface 27*b* and extends in a direction away from the mounting surface G.

As illustrated in FIGS. 2 and 5 to 7, the attachment surface 27*c* is formed so as to be sloped greater in an upward direction B at a section closer to the distal end 27*g* of the arm 27 than a section, in which the arm contact surface 27*b* is formed, in the attachment folded posture.

The work device cylinder 32 is attached to the attachment surface 27*c* so as not to make contact with the mounting surface G when the arm contact surface 27*b* makes contact with the mounting surface G Specifically, as illustrated in FIG. 2, a base-side end portion of the work device cylinder 32 is connected to the bracket 27*f* attached to the attachment surface 27*c* so as to be rotatable about the horizontal axis. Since the lower end of the bracket 27*f* is positioned above the arm contact surface 27*b* in the attachment folded posture, the bracket 27*f* will not make contact with a ground or the like. The distal end portion 32*b* of a cylinder body 32*a* of the work device cylinder 32 is linked to a portion close to the distal end 27*g* of the arm 27 by a link arm 33. That is, one end portion of the link arm 33 is connected to the distal end portion 32*b* of the cylinder body 32*a* of the work device cylinder 32 by a link pin 33*a* so as to be rotatable about the horizontal axis. Moreover, the other end portion of the link arm 33 is connected to a portion close to the distal end 27*g* of the arm 27 by a link pin 33*b* so as to be rotatable about the horizontal axis. A rod 32*c* of the work device cylinder 32 can advance and retract in a front-rear direction of the cylinder body.

As illustrated in FIG. 2, the boom upper surface 25*b*2 of the front boom 25*b* facing upward when the attachment is in the attachment folded posture, and the boom upper surface is formed to be more parallel to the arm contact surface 27*b* than the boom-side sloped surface 25*b*4 and the arm-side sloped surface 27*e* or to be parallel to the arm contact surface 27*b* when the attachment is in the attachment folded posture. Due to this, it is possible to decrease the height H2 of the attachment when it is in the folded posture.

Moreover, as illustrated in FIG. 2, the front boom 25*b* has a boom-side facing surface 25*b*3 that is disposed on the base side (the right side of FIG. 2) of the front boom 25*b* so as to face downward when the attachment is in the attachment folded posture. On the other hand, the arm 27 has an arm-side facing surface 27*d* that is disposed on the distal end 27*g* side (the right side of FIG. 2) so as to face upward when the attachment is in the attachment folded posture. The boom-side facing surface 25*b*3 and the arm-side facing surface 27*d* face each other when the attachment is in the attachment folded posture. The boom-side facing surface 25*b*3 is formed to be more parallel to the arm-side facing surface 27*d* than the boom-side sloped surface 25*b*4 and the arm-side sloped surface 27*e* or to be parallel to the arm-side facing surface 27*d* when the attachment is in the attachment folded posture. Due to this, it is possible to decrease the distance between the boom-side facing surface 25*b*3 and the arm-side facing surface 27*d* as compared to the conventional machine.

Specifically, the arm-side facing surface 27*d* is positioned closer to the distal end of the arm 27 than the arm-side sloped surface 27*e* in which the attachment portion 27*a* for connecting the arm cylinder 31 is formed. Moreover, the boom-side facing surface 25*b*3 is positioned closer to the base side of the folded state 25*b* than the boom-side sloped surface 25*b*4 in which the attachment portion 25*b*1 for connecting the inter-boom cylinder 30 is formed. Due to this, it is possible to decrease the distance between the boom-side facing surface 25*b*3 and the arm-side facing surface 27*d* in a state where the inter-boom cylinder 30 and the arm cylinder 31 crossing each other are received in a space 34 surrounded by the arm-side sloped surface 27*e*, the boom-side sloped surface 25*b*4, and the inter-boom 26.

Moreover, the work attachment 24 illustrated in FIG. 2 is manufactured so that the center of gravity of the work attachment 24 is positioned on the arm contact surface 27*b* in the attachment folded posture.

Features of Present Embodiment (1) In the demolishing machine of the present embodiment, the work attachment 24 can be folded in a three-fold manner into such an attachment folded posture that the boom 25*b* is disposed above the inter-boom 26 and the arm 27 is disposed below the inter-boom. The arm 27 has a surface facing downward when the attachment is in the attachment folded posture. The surface includes the flat arm contact surface 27*b* capable of making contact with the mounting surface G (for example, a ground, a floor, or the like) on which the attachment is mounted, and the attachment surface 27*c* that is positioned closer to the distal end 27*g* of the arm 27 than the arm contact surface 27*b* and extends in the direction away from the mounting surface G The work device cylinder 32 is attached to the attachment surface 27*c* so as not to make contact with the mounting surface G when the arm contact surface 27*b* makes contact with the mounting surface G. Due to this, when the attachment 24 is in the attachment folded posture, the space occupied by the work device cylinder 32 decreases and the height of the attachment 24 in the folded posture can be decreased. Moreover, the attachment 24 can be mounted on the predetermined mounting surface G such as a ground, a floor, or the like in a stable state.

Further, since the position at which the work device cylinder 32 is attached to the arm 27 is the same as the conventional demolishing machine, it is not necessary to change a method of operating the demolishing machine and to suppress the influence on the operability during demolishing.

Further, the inter-boom cylinder 30 is attached between the inter-boom 26 and the boom-side sloped surface 25*b*4 formed close to the distal end of the front boom 25*b*, and the arm cylinder 31 is attached between the inter-boom 26 and the arm-side sloped surface 27*e* formed on the base side of the arm 27. Due to this, when the attachment 24 is in the folded posture, the inter-boom cylinder 30 and the arm cylinder 31 are received between the boom-side sloped surface 25*b*4 and the arm-side sloped surface 27*e* in a state of crossing each other. The boom upper surface 25*b*2 of the boom 27 facing upward when the attachment is in the attachment folded posture is more parallel to the arm contact surface 27*b* than the boom-side sloped surface 25*b*4 and the arm-side sloped surface 27*e* or is parallel to the arm contact surface 27*b* when the attachment is in the attachment folded posture. Due to this, it is possible to decrease the overall height of the attachment in the folded posture as compared to when the boom upper surface 25*b*2 is sloped with respect to the arm contact surface 27*b*.

(2) In the demolishing machine of the present embodiment, the inter-boom cylinder 30 and the arm cylinder 31 are disposed so as to cross each other in a side view of the work attachment 24 when the work attachment 24 is in the attachment folded posture. Due to this, the space occupied by the inter-boom cylinder 30 and the arm cylinder 31 decreases when the attachment 24 is in the folded posture, and the height of the attachment 24 in the folded posture can be decreased.

(3) In the demolishing machine of the present embodiment, the boom-side facing surface 25*b*3 formed on the base side of the front boom 25*b* is more parallel to the arm-side facing surface 27*d* formed close to the distal end 27*g* of the arm 27 than the boom-side sloped surface 25*b*4 and the arm-side sloped surface 27*e* or is parallel to the arm-side facing surface 27*d* when the attachment is in the attachment folded posture. Due to this, it is possible to decrease the distance between the boom-side facing surface 25*b*3 and the arm-side facing surface 27*d* facing each other and to further decrease the height of the attachment 24 in the folded posture.

Moreover, since the height of the entire attachment in the folded state is constant, it is effective from the perspective of both transporting property and maintenance operability.

(4) In the demolishing machine of the present embodiment, the center of gravity of the work attachment 24 is positioned on the arm contact surface 27*b* in the folded posture. Due to this, the work attachment 24 in the folded posture can be mounted on a predetermined ground or a predetermined floor in a more stable state.

(Modification)

(A) In the above-described embodiment, although the demolishing machine has been described as an example of the work machine of the present invention, the present invention is not limited to this but can be applied to other work machines such as a work machine in which a lifting magnet is attached to a distal end of an attachment.

(B) In the above-described embodiment, although a configuration in which, when the work attachment 24 is in the attachment folded posture, the inter-boom cylinder 30 and the arm cylinder 31 cross each other in a side view of the work attachment 24 has been described as an example, the present invention is not limited to this, and the inter-boom cylinder 30 and the arm cylinder 31 may not cross each other (for example, these two cylinders 30 and 31 are disposed at the same phase (the same position in the width direction of the attachment when seen from the above in the attachment folded posture)).

The specific embodiment described above mainly includes inventions having the following configuration.

A work machine of the present invention is a work machine in which a work attachment is attached to a base machine, the work attachment including: a boom attached to the base machine so as to be raised and lowered; an inter-boom attached to a distal end of the boom so as to be rotatable about a horizontal axis; an arm attached to a distal end of the inter-boom so as to be rotatable about the horizontal axis; a work device attached to a distal end of the arm; an inter-boom cylinder provided on a belly side of the work attachment and between the boom and the inter-boom so as to rotate the inter-boom; an arm cylinder provided on the belly side of the work attachment and between the inter-boom and the arm so as to move the arm; and a work device cylinder provided in a portion of a back side of the work attachment close to the distal end of the arm, wherein the work attachment can be folded in a three-fold manner into such an attachment folded posture that the boom is disposed on the upper side of the inter-boom and the arm is disposed on the lower side of the inter-boom, the boom has a boom-side sloped surface that is disposed on a distal end side of the boom and on a lower side of the boom in the attachment folded posture so as to be sloped downward as the boom-side sloped surface advances toward a base side of the boom, and the inter-boom cylinder is attached between the boom-side sloped surface and the inter-boom, the arm has an arm-side sloped surface that is disposed on a base side of the arm and on an upper side of the arm in the attachment folded posture so as to be sloped upward as the arm-side sloped surface advances toward the distal end of the arm, and the arm cylinder is attached between the arm-side sloped surface and the inter-boom, the arm has a surface facing downward when the attachment is in the attachment folded posture, the surface including, a flat arm contact surface capable of making contact with a mounting surface, on which the work attachment is mounted, and an attachment surface that is positioned closer to the distal end of the arm than the arm contact surface and extends in a direction away from the mounting surface, and the work device cylinder is attached to the attachment surface so as not to make contact with the mounting surface when the arm contact surface makes contact with the mounting surface, and the boom has a boom upper surface that faces upward when the attachment is in the attachment folded posture, and the boom upper surface is formed to be more parallel to the arm contact surface than the boom-side sloped surface and the arm-side sloped surface or to be parallel to the arm contact surface when the attachment is in the attachment folded posture.

According to this configuration, the work attachment can be folded in a three-fold manner into such an attachment folded posture that the boom is disposed above the inter-boom and the arm is disposed below the inter-boom. The arm has the surface facing downward when the attachment is in the attachment folded posture, and the surface includes the flat arm contact surface capable of making contact with the mounting surface on which the work attachment is mounted, and the attachment surface that is positioned closer to the distal end of the arm than the arm contact surface and extends in the direction away from the mounting surface. The work device cylinder is attached to the attachment surface so as not to make contact with the mounting surface when the arm contact surface makes contact with the mounting surface such as a ground or a floor. Due to this, when the attachment is in the attachment folded posture, the space occupied by the work device cylinder decreases and the height of the attachment in the folded posture can be decreased. Moreover, the attachment can be mounted on a predetermined ground, a predetermined floor, or the like in a stable state. Further, since the position at which the work device cylinder is attached to the arm is the same as the conventional demolishing machine, it is not necessary to change a method of operating the demolishing machine and to suppress the influence on the operability during demolishing.

Further, the inter-boom cylinder is attached between the inter-boom and the boom-side sloped surface formed close to the distal end of the boom, and the arm cylinder is attached between the inter-boom and the arm-side sloped surface formed on the base side of the arm. Due to this, when the attachment is in the attachment folded posture, the inter-boom cylinder and the arm cylinder are received between the boom-side sloped surface and the arm-side sloped surface. Moreover, the boom upper surface of the boom facing upward when the attachment is in the attachment folded posture is more parallel to the arm contact surface than the boom-side sloped surface and the arm-side sloped surface or is parallel to the arm contact surface when the attachment is in the attachment folded posture. Due to this, it is possible to decrease the height of the attachment in the folded posture as compared to when the boom upper surface is sloped with respect to the arm contact surface.

The work machine may be configured so that, the inter-boom cylinder and the arm cylinder are disposed so as to cross each other in a side view of the work attachment when the work attachment is in the attachment folded posture.t.

According to this configuration, the inter-boom cylinder and the arm cylinder are disposed so as to cross each other in a side view of the work attachment when the work attachment is in the attachment folded posture. Due to this, the space occupied by the inter-boom cylinder and the arm cylinder decreases when the attachment is in the attachment folded posture, and the height of the attachment in the folded posture can be decreased.

The work machine may be configured so that the boom has a boom-side facing surface that is disposed on the base side of the boom so as to face downward when the attachment is in the attachment folded posture, the arm has an arm-side facing surface that is disposed on the distal end side of the arm so as to face upward when the attachment is in the attachment folded posture, the boom-side facing surface and the arm-side facing surface face each other when the attachment is in the attachment folded posture, and the boom-side facing surface is formed to be more parallel to the arm-side facing surface than the boom-side sloped surface and the arm-side sloped surface or to be parallel to the arm-side facing surface when the attachment is in the attachment folded posture.

According to this configuration, the boom-side facing surface formed on the base side of the boom is more parallel to the arm-side facing surface formed close to the distal end of the arm than the boom-side sloped surface and the arm-side sloped surface or is parallel to the arm-side facing surface when the attachment is in the attachment folded posture. Due to this, it is possible to decrease the distance between the boom-side facing surface and the arm-side facing surface facing each other and to further decrease the height of the attachment in the folded posture.

The work machine may be configured so that the work attachment has a center of gravity that is positioned on the arm contact surface in the attachment folded posture.

According to this configuration, the center of gravity of the work attachment is positioned on the arm contact surface in the attachment folded posture. Due to this, the work attachment in the folded posture can be mounted on a predetermined ground or a predetermined floor in a stable state.

EXPLANATION OF REFERENCE NUMERALS

21: lower traveling body
22: upper turning body
23: base machine
24: work attachment
25: boom
25*a*: main boom
25*b*: front boom
25*b*2: boom upper surface
25*b*3: boom-side facing surface
25*c*: insert boom
26: inter-boom
27: arm
27*b*: arm contact surface
27*c*: attachment surface
27*d*: arm-side facing surface
29: boom cylinder
30: inter-boom cylinder
31: arm cylinder
32: work device cylinder

The invention claimed is:

1. A work machine in which a work attachment is attached to a base machine, the work attachment having:

a boom attached to the base machine so as to be raised and lowered;

an inter-boom attached to a distal end of the boom so as to be rotatable about a horizontal axis;

an arm attached to a distal end of the inter-boom so as to be rotatable about the horizontal axis;

a work device attached to a distal end of the arm;

an inter-boom cylinder provided on a belly side of the work attachment and between the boom and the inter-boom so as to rotate the inter-boom;

an arm cylinder provided on the belly side of the work attachment and between the inter-boom and the arm so as to move the arm; and a work device cylinder provided in a portion of a back side of the work attachment close to the distal end of the arm, wherein the work attachment can be folded in a three-fold manner into such an attachment folded posture that the boom is disposed on the upper side of the inter-boom and the arm is disposed on the lower side of the inter-boom, the boom has a boom-side sloped surface that is disposed on a distal end side of the boom and on a lower side of the boom in the attachment folded posture so as to be sloped downward as the boom-side sloped surface advances toward a base side of the boom, and the inter-boom cylinder is attached between the boom-side sloped surface and the inter-boom, the arm has an arm-side sloped surface that is disposed on a base side of the arm and on an upper side of the arm in the attachment folded posture so as to be sloped upward as the arm-side sloped surface advances toward the distal end of the arm, and the arm cylinder is attached between the arm-side sloped surface and the inter-boom, the arm has a surface facing downward when the attachment is in the attachment folded posture, the surface facing downward including an arm contact surface which is a flat surface capable of making contact with a mounting surface within an overall area of the flat surface, the mounting surface being a surface on which the work attachment is mounted, and an attachment surface that is positioned closer to the distal end of the arm than the arm contact surface and extends in a direction away from the mounting surface, and the work device cylinder is attached to the attachment surface so as not to make contact with the mounting surface when the arm contact surface makes contact with the mounting surface, and the boom has a boom upper surface that faces upward when the attachment is in the attachment folded posture, and the boom upper surface is formed to be more parallel to the arm contact surface than the boom-side sloped surface and the arm-side sloped surface or to be parallel to the arm contact surface when the attachment is in the attachment folded posture, wherein all portions of the work device cylinder are provided at positions more upward than the arm contact surface when the arm contact surface makes contact with the mounting surface along an overall area of the flat surface, wherein the work device cylinder is attached to the attachment surface by a bracket having a lower surface positioned upward of the arm contact surface in a state where the arm contact surface makes contact with the mounting surface along an overall area of the flat surface, and wherein the work device cylinder and the bracket are positioned in a space defined between the attachment surface and a plane including the flat surface of the arm contact surface.

2. The work machine according to claim 1, wherein the inter-boom cylinder and the arm cylinder are disposed so as to cross each other in a side view of the work attachment when the work attachment is in the attachment folded posture.

3. The work machine according to claim 1, wherein the boom has a boom-side facing surface that is disposed on the base side of the boom so as to face downward when the attachment is in the attachment folded posture, the arm has an arm-side facing surface that is disposed on the distal end side of the arm so as to face upward when the attachment is in the attachment folded posture, the boom-side facing surface and the arm-side facing surface face each other when the attachment is in the attachment folded posture, and the boom-side facing surface is formed to be more parallel to the arm-side facing surface than the boom-side sloped surface and the arm-side sloped surface or to be parallel to the arm-side facing surface when the attachment is in the attachment folded posture.

4. The work machine according to claim 1, wherein the work attachment has a center of gravity that is positioned over the arm contact surface when the work attachment is in a generally horizontal position in the attachment folded posture.

5. The work machine according to claim 1, wherein the boom includes a main boom attached to the base machine a front boom, and an insert boom interposed between the main boom and the front boom, and the insert boom is connected with the front boom at a position lower than a position at which the insert boom and the main boom are connected to each other.

* * * * *